US008186266B2

(12) United States Patent
Chen

(10) Patent No.: US 8,186,266 B2
(45) Date of Patent: May 29, 2012

(54) OIL EXPELLER

(75) Inventor: Yu-Lun Chen, Sanwan Township (TW)

(73) Assignee: Golden-Flower Tea Oil Production Co., Ltd., Miaoli County (TW)

( * ) Notice: Subject to any disclaimer, the term of this patent is extended or adjusted under 35 U.S.C. 154(b) by 116 days.

(21) Appl. No.: 12/823,595

(22) Filed: Jun. 25, 2010

(65) Prior Publication Data

US 2011/0005411 A1 Jan. 13, 2011

(30) Foreign Application Priority Data

Jul. 10, 2009 (TW) ..... 98212692 U

(51) Int. Cl.
*B30B 9/06* (2006.01)

(52) U.S. Cl. .... 100/126; 100/127; 100/264; 100/269.01

(58) Field of Classification Search ..... 100/104, 100/126, 127, 130, 131, 135, 264, 902, 269.01
See application file for complete search history.

(56) References Cited

U.S. PATENT DOCUMENTS 110,346 A * 12/1870 Desgoppe ..... 100/264
467,783 A * 1/1892 Sailor ..... 100/3
3,996,849 A * 12/1976 Del Jiacco ..... 100/218
4,730,555 A * 3/1988 Blanchot ..... 100/37
5,125,331 A * 6/1992 Wood ..... 100/37
7,131,371 B1 * 11/2006 Shober et al. ..... 100/126

* cited by examiner

*Primary Examiner* — Jimmy T Nguyen
(74) *Attorney, Agent, or Firm* — Muncy, Geissler, Olds & Lowe, PLLC

(57) ABSTRACT

An oil expeller has a stand with an upper cylinder and a lower cylinder, an oil filter mounted on the stand and a control device controlling the upper and lower cylinders. The oil filter has a filter tank and two pressing panels mounted in the filter tank. Raw materials are disposed between the pressing panels. Thus, the upper cylinder presses a corresponding pressing panel and the raw materials to extract oil from the raw materials. The lower cylinder pushes a corresponding pressing panel and waste product out of the filter tank. The oil expeller takes up little space, operates easily and extracts oil from the raw materials 40 and removes the waste product alternately. Moreover, the user is allowed to provide fresh oil based on his needs when extracting oil from a suitable amount of raw materials.

12 Claims, 8 Drawing Sheets

OIL EXPELLER

BACKGROUND OF THE INVENTION

1. Field of the Invention

The present invention relates to an oil expeller, especially to an oil expeller that is easily operated and allows for extracting oil from a small amount of raw materials.

2. Description of the Prior Art(s)

A conventional way to extract oil from raw materials such as nuts, seeds and the like is to fry and crush the raw materials, to package the raw materials in a filter bag and then to put the filter bag in a conventional oil expeller to extract oil from the raw materials. The filter bag is removed from the conventional oil expeller until no more oil is extracted from the raw materials.

However, preparing the raw materials (e.g. frying, crushing and packaging the raw materials) is inconvenient and a waste of time. Moreover, the conventional oil expeller needs to operate with a large amount of raw materials and with a large quantity of extracted oil. The quantity of oil is fixed and is not based on users' needs. Thus, extracting the large amount of raw materials not only takes time, but the unused oil in contact with the air for a long time has reduced quality.

To overcome the shortcomings, the present invention provides an oil expeller to mitigate or obviate the aforementioned problems.

SUMMARY OF THE INVENTION

The main objective of the present invention is to provide an oil expeller. The oil expeller has a stand with an upper cylinder and a lower cylinder, an oil filter mounted on the stand and a control device controlling the upper and lower cylinders. The oil filter has a filter tank and two pressing panels mounted in the filter tank. Raw materials are disposed between the pressing panels.

Thus, the upper cylinder presses a corresponding pressing panel and the raw materials to extract oil from the raw materials. The lower cylinder pushes a corresponding pressing panel and waste product out of the filter tank.

The oil expeller takes up little space, operates easily and extracts oil from the raw materials and removes the waste product alternately. Moreover, the user is allowed to provide fresh oil based on his needs when extracting oil from a suitable amount of raw materials.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
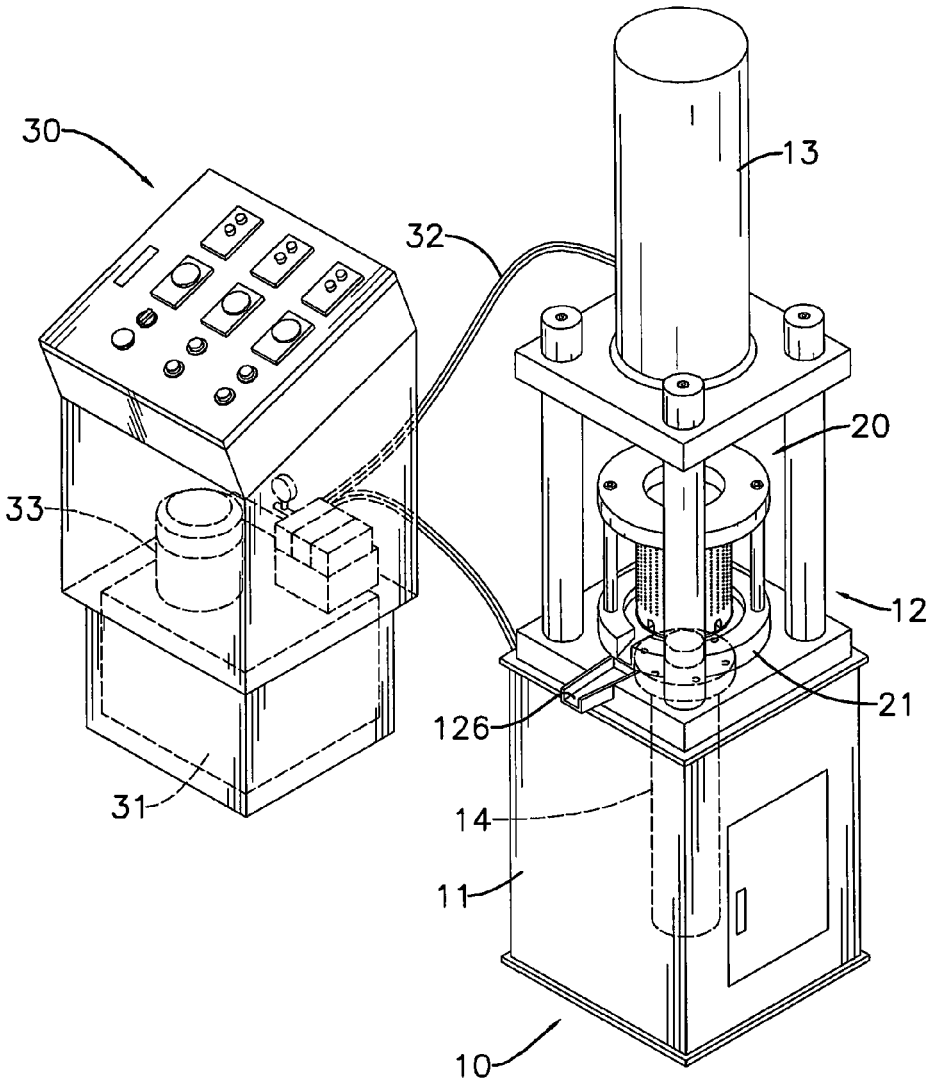
FIG. 1 is a perspective view of an oil expeller in accordance with the present invention.

With reference to FIG. 1, an oil expeller in accordance with the present invention comprises a stand 10, an oil filter 20 and a control device 30.

The stand 10 has a base 11, a supporting bracket 12, an upper cylinder 13 and a lower cylinder 14.

Figure 2:
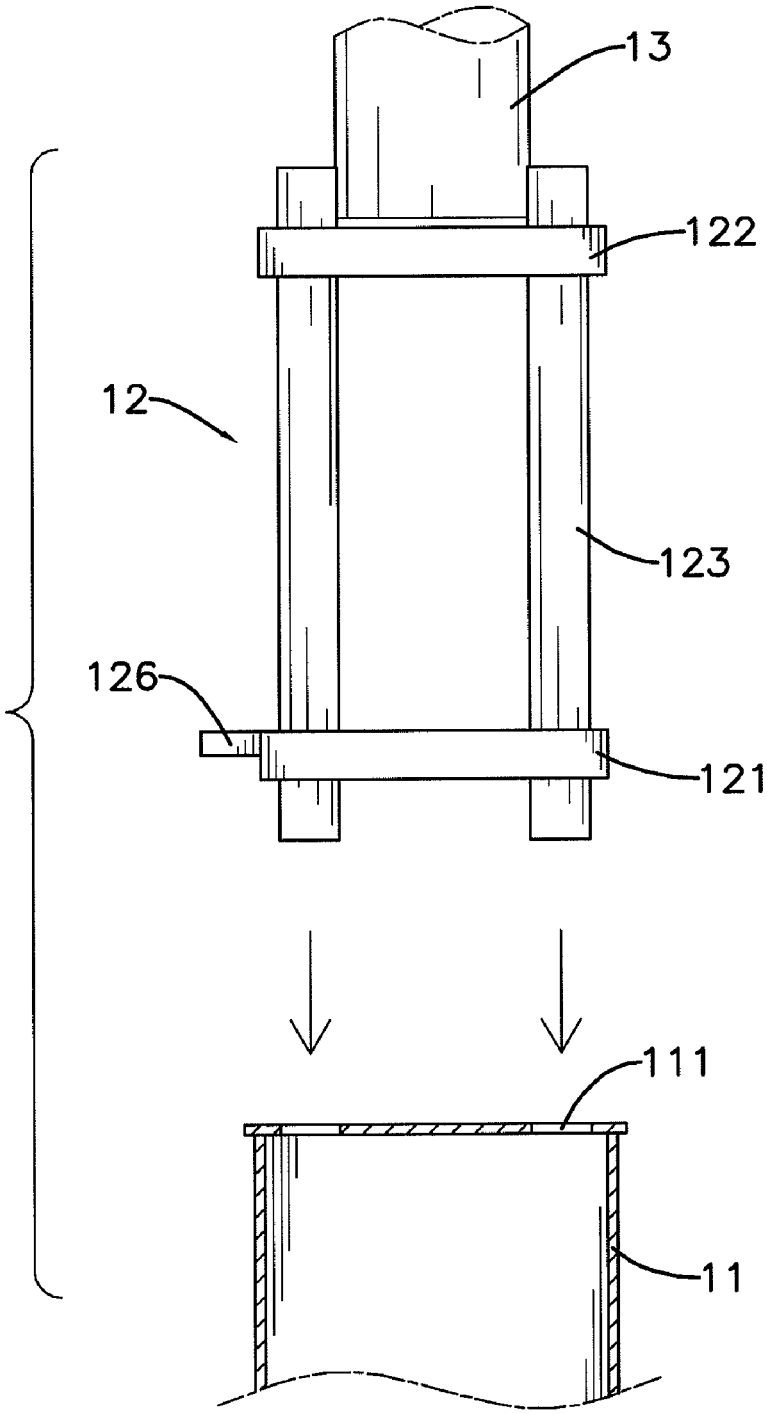
FIG. 2 is an exploded side view in partial section of a base and a supporting bracket of the oil expeller in FIG. 1.

With further reference to FIG. 2, the base 11 is hollow and has a through hole and multiple positioning holes 111. The through hole of the base 11 is formed through an upper surface of the base 11. The positioning holes 111 are formed separately through the upper surface of the base 11 and are arranged around the through hole of the base 11.

Figure 3:
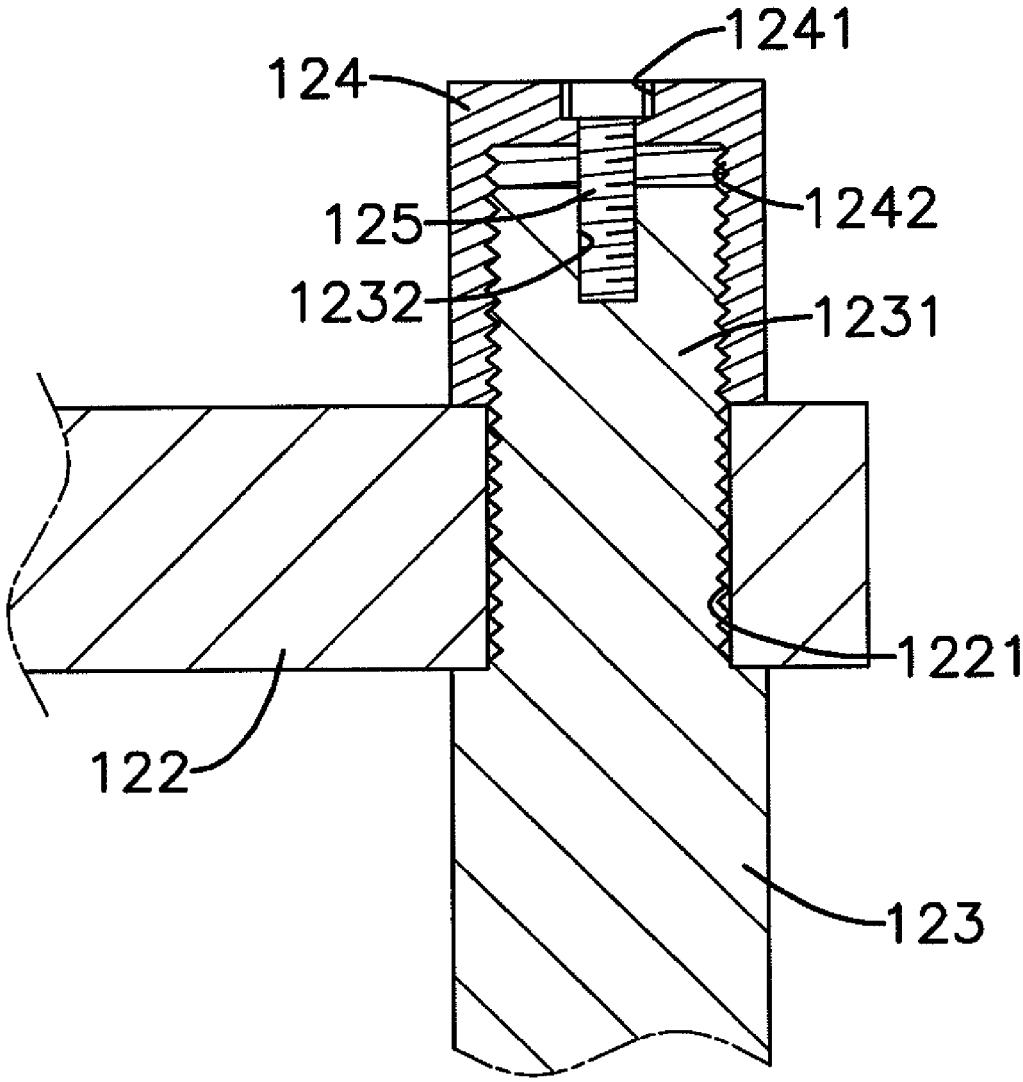
FIG. 3 is an enlarged side view in partial section of the supporting bracket of the oil expeller in FIG. 1.

With further reference to FIG. 3, the supporting bracket 12 is mounted securely on the upper surface of the base 11 and has a lower holder 121, an upper holder 122, multiple connecting rods 123, multiple sleeves 124, multiple bolts 125 and at least one oil guider 126.

The lower holder 121 has a through hole, multiple fastening holes and at least one guider recess. The through hole of the lower holder 121 is formed through the lower holder 121 and aligns with the through hole of the base 11. The fastening holes of the lower holder 121 are formed separately through the lower holder 121 and are arranged around the through hole of the lower holder 121. The at least one guider recess is formed in an upper surface of the lower holder 121 and through a side surface of the lower holder 121. The upper holder 122 is mounted upper the lower holder 121 and has a through hole and multiple fastening holes 1221. The through hole of the upper holder 122 is formed through the upper holder 122. The fastening holes 1221 are formed separately through the upper holder 122 and are arranged around the through hole of the upper holder 122. The connecting rods 123 are mounted securely between the lower and upper holders 121, 122. Each connecting rod 123 has two screws 1231 and two threaded holes 1232. The screws 1231 protrude respectively from two opposite ends of the connecting rod 123 and are mounted respectively through corresponding fastening holes 1221 of the lower and upper holders 121, 122. The threaded holes 1232 are formed respectively in distal ends of the screws 1231.

The sleeves 124 are respectively mounted securely around the screws 1231 of the connecting rods 123. Each sleeve 124 has an open end, a closed end, a countersink 1241 and an inner thread 1242. The countersink 1241 is formed through the closed end of the sleeve 124. The inner thread 1242 is formed around an inner surface of the sleeve 124 and fastens to a corresponding screw 1231 of a corresponding connecting rod 123. The sleeves 124 that are disposed on the lower holder 121 are mounted respectively in the positioning holes 111 of the base 11 so the supporting bracket 12 is mounted stably on the base 11. The bolts 125 are mounted respectively through the countersinks 1241 of the sleeves 124 and fasten to the threaded holes 1232 of the connecting rods 123. Thus, connections between the lower and upper holder 121, 122 and the connecting rods 123 are not only stable and secure, but also neat and aesthetically pleasing.

The at least one oil guider 126 is mounted in the at least one guider recess of the lower holder 121 and protrudes out of the side surface of the lower holder 121.

Figure 7:
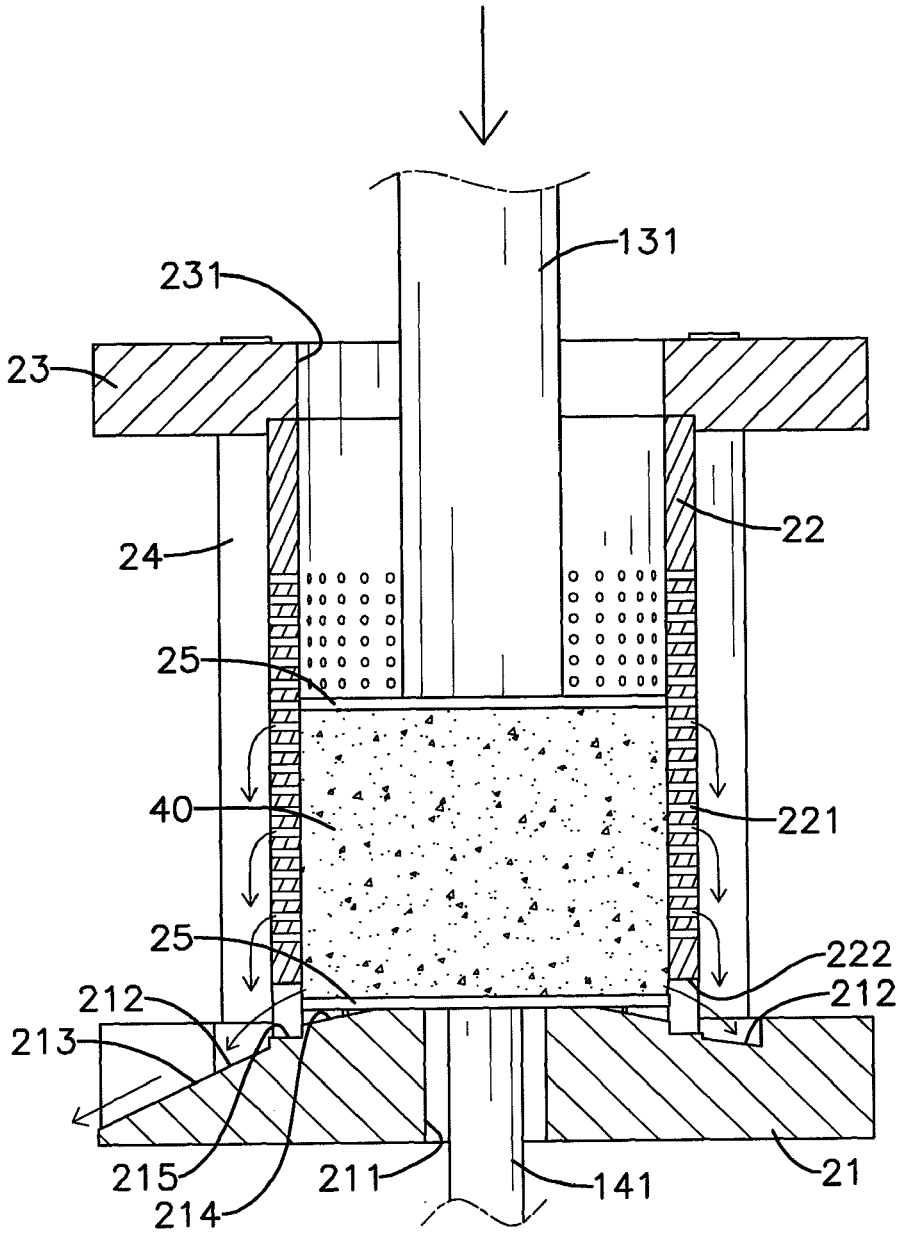
FIG. 7 is an enlarged operational side view in partial section of the oil expeller in FIG. 1, shown extracting raw materials.

With further reference to FIG. 7, the upper cylinder 13 is mounted on the upper holder 122 of the supporting bracket 12 and has a piston rod 131 mounted retractably down through the through hole of the upper holder 122.

Figure 8:
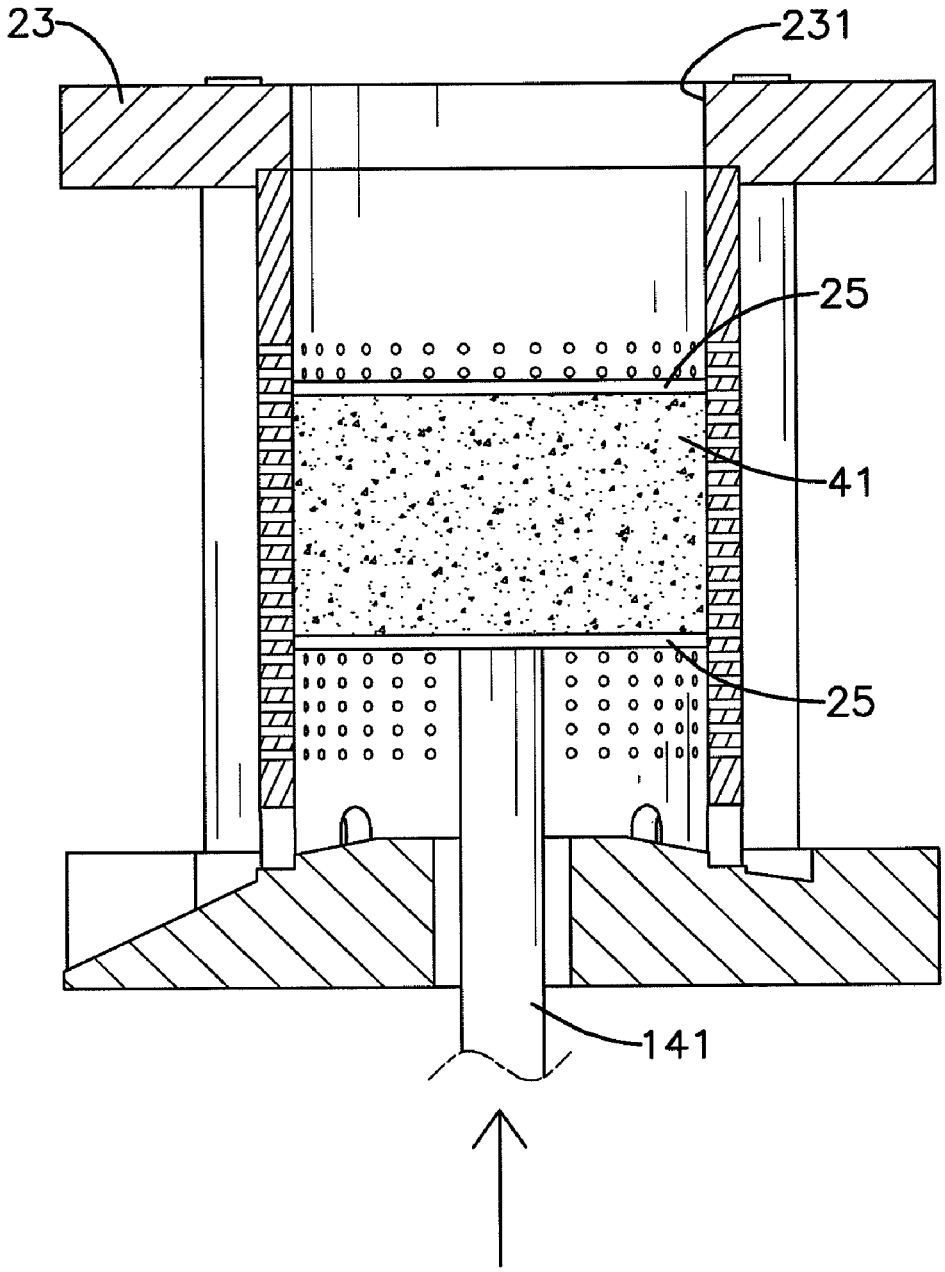
FIG. 8 is an enlarged operational side view in partial section of the oil expeller in FIG. 1, shown removing the raw materials from the oil filter.

With further reference to FIG. 8, the lower cylinder 14 is mounted in the base 11 and has a piston rod 141 mounted retractably up through the through holes of the base 11 and the lower holder 121.

Figure 4:
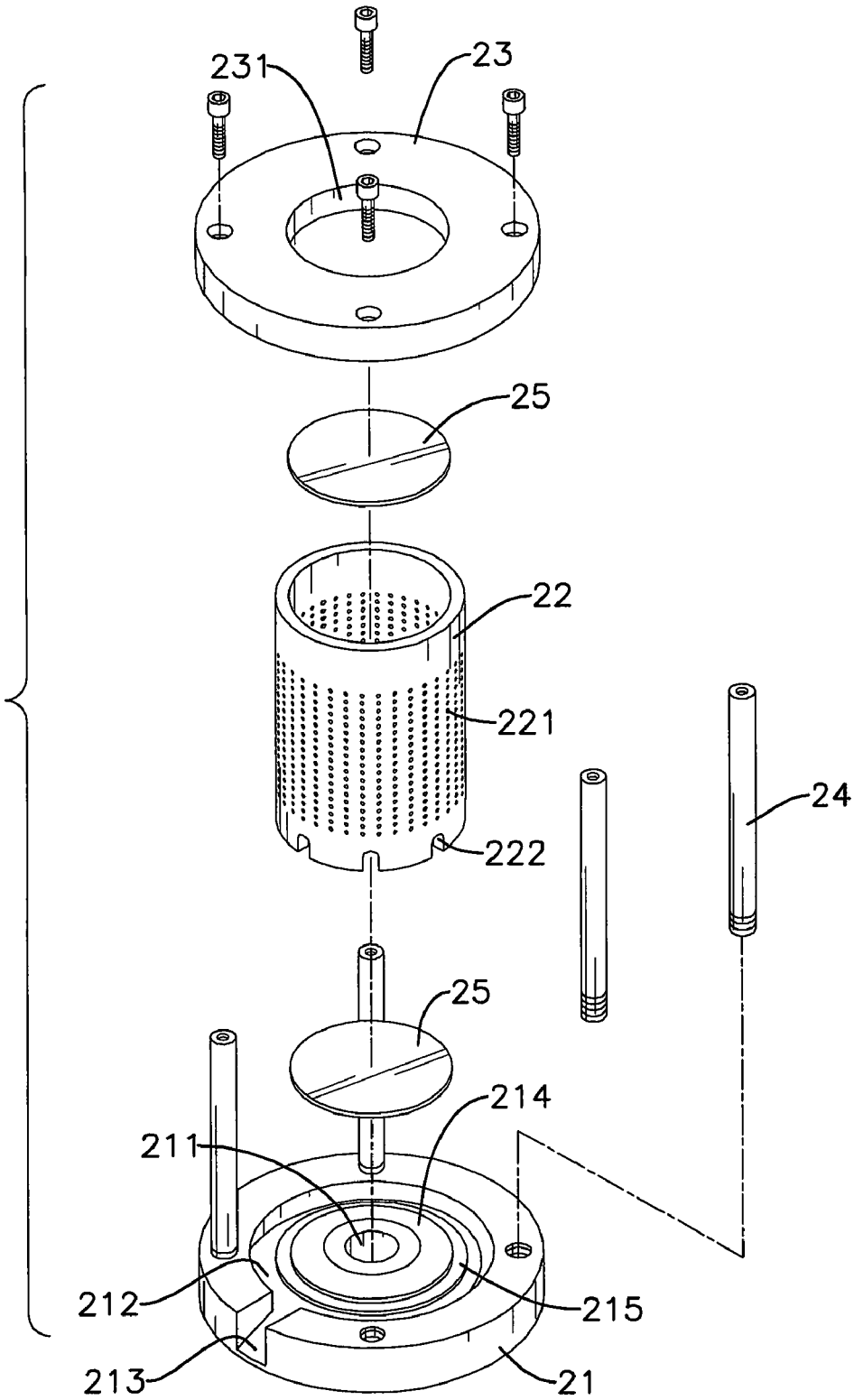
FIG. 4 is an exploded perspective view of an oil filter of the oil expeller in FIG. 1.

With further reference to FIG. 4, the oil filter 20 is mounted in the supporting bracket 12 of the stand 10 and has an oil guiding base 21, a filter tank 22, a cover 23, multiple supporting rods 24 and two pressing panels 25.

Figure 5:
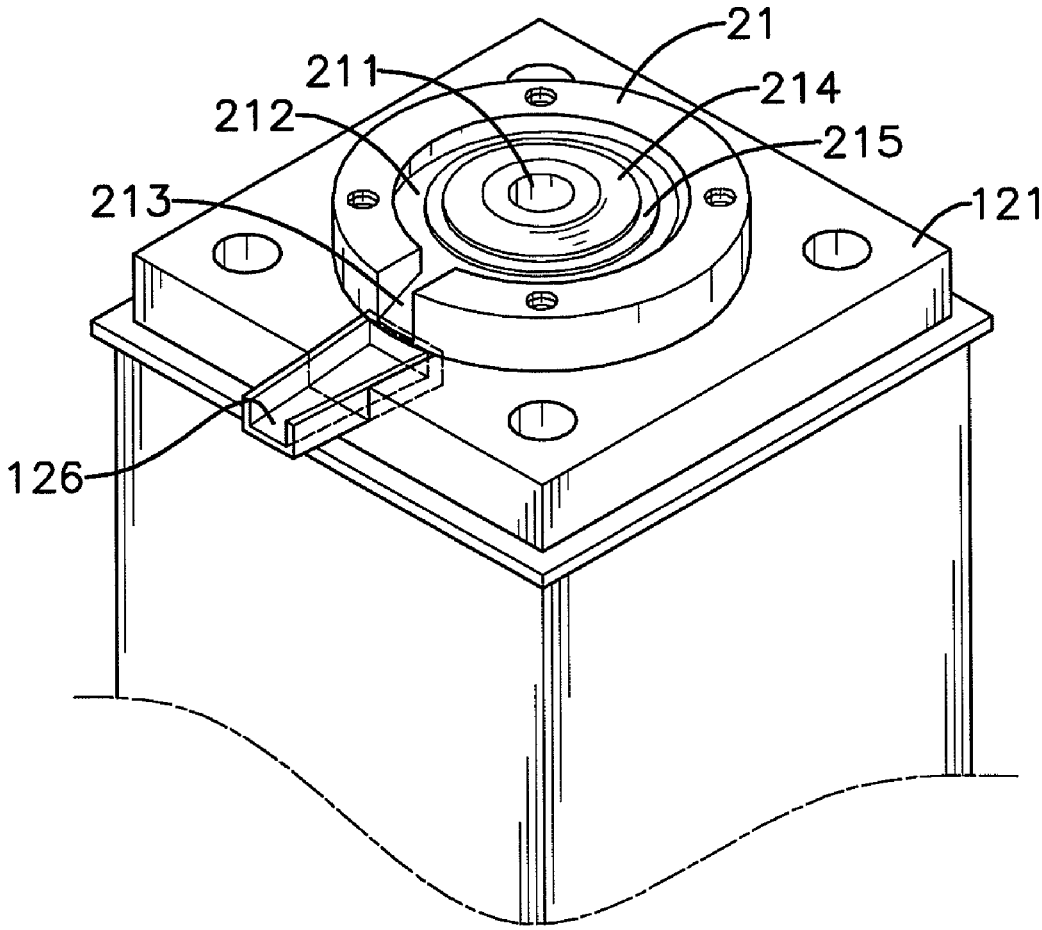
FIG. 5 is an enlarged perspective view of the oil expeller in FIG. 1.

With further reference to FIG. 5, the oil guiding base 21 is mounted on the lower holder 121 of the supporting bracket 12 and has a lower through hole 211, an annular groove 212, an outer oil guiding surface, at least one oil outlet 213, an inner oil guiding surface 214 and a positioning recess 215. The lower through hole 211 is formed through the oil guiding base 21 and aligns with the through hole of the lower holder 121.

Figure 6:
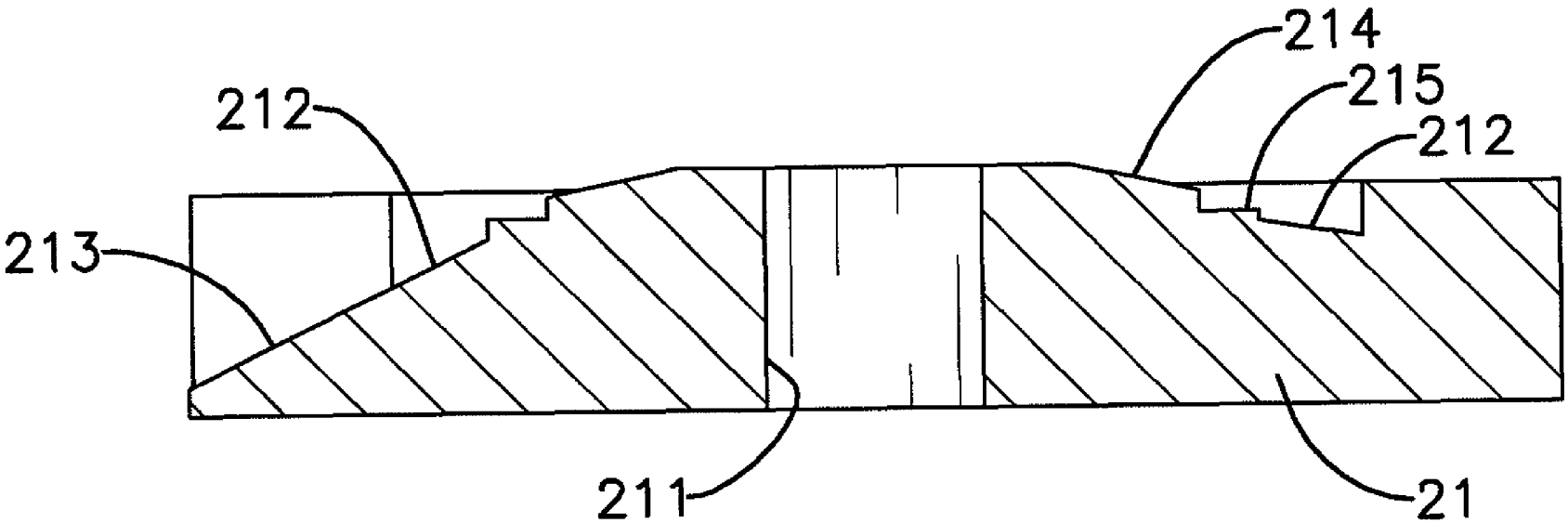
FIG. 6 is a cross-sectional side view of an oil guiding base of the oil filter of the oil expeller in FIG. 1.

With further reference to FIG. 6, the annular groove 212 is formed in an upper surface of the oil guiding base 21 and around the lower through hole 211 of the oil guiding base 21. The outer oil guiding surface is defined in the annular groove 212, is sloped and has at least one low point. The at least one oil outlet 213 is formed in a side surface of the oil guiding base 21, communicates with the annular groove 212 and corresponds to the at least one low point of the outer oil guiding surface and the at least one oil guider 126 of the supporting bracket 12. Thus, fluid in the annular groove 212 flows toward and gathers to the at least one low point of the outer oil guiding surface and then flows out through the at least one oil outlet 213 and the oil guider 123.

The inner oil guiding surface 214 is formed around the lower through hole 211 of the oil guiding base 21, is disposed between the lower through hole 211 and the annular groove 212 and is sloped down from the lower through hole 211 to the side surface of the oil guiding base 21. The positioning recess 215 is formed around and between the annular groove 212 and the inner oil guiding surface 214.

The filter tank 22 is mounted on the oil guiding base 21, is mounted around the positioning recess 215 of the oil guiding base 21 and has multiple oil drain holes 221 and multiple oil flowing indentations 222. The oil drain holes 221 are formed through the filter tank 22. The oil flowing indentations 222 are formed separately in a lower peripheral edge of the filter tank 22. Each oil flowing indentation 222 has a height higher than a drop height between the inner oil guiding surface 214 and the positioning recess 215. Thus, the fluid on the inner oil guiding surface 214 flows through the oil flowing indentation 222 of the filter tank 22 and flows into the annular groove 212.

The cover 23 is mounted on an upper peripheral edge of the filter tank 22 and has an upper through hole 231 formed through the cover 23.

The supporting rods 24 are mounted securely between the oil guiding base 21 and the cover 23.

The pressing panels 25 are mounted movably in the filter tank 22. Raw materials 40, such as tea seeds, peanuts, sesame, sunflower seeds and the like, that are rich in oil are disposed between the pressing panels 25.

The control device 30 is disposed beside the stand 10 and has an oil tank 31, multiple oil pipes 32 and an oil control valve 33. The oil pipes 32 communicate the oil tank 31 to the upper and lower cylinders 13, 14. The oil control valve 33 controls oil flow between the oil tank 31 and the upper and lower cylinders 13, 14 to extend and retract the piston rods 131, 141 of the upper and lower cylinders 13, 14 so the pressing panels 25 are moved by the piston rods 131, 141 of the upper and lower cylinders 13, 14.

With reference to FIG. 7, the raw materials 40 are packaged in a filter bag and the filter bag is disposed between the pressing panels 25 in the filter tank 22. The piston rod 131 of the upper cylinder 13 extends and presses a corresponding pressing panel 25 and the raw materials 40 in high pressure to extract oil from the raw materials 40. Then the oil filters out of the filter tank 22 through the oil drain holes 221 of the filter tank 22 and flows along side surface of the filter tank 22 to the annular groove 212 of the oil guiding base 21. The inner oil guiding surface 214 of the oil guiding base 21 prevents the oil from flowing into the lower through hole 211 of the oil guiding base 21 and damaging the lower cylinder 14.

Then the oil collected in the annular groove 212 of the oil guiding base 21 flows out of the oil expeller through the at least one oil outlet 213 of the oil guiding base 21 and the at least one oil guider 126 of the supporting bracket 12 and flows into containers.

With further reference to FIG. 8, when no more oil is extracted from the raw materials, the piston rod 131 of the upper cylinder 13 retracts. Then the piston rod 141 of the lower cylinder 14 extends to push the pressing panels 25 of the oil filter 20 and waste product 41 in the filter bag upwardly until the filter bag is pushed out of the upper through hole 231 of the cover 23. Thus, the filter bag is easily removed.

Then the piston rod 141 of the lower cylinder 14 retracts and a corresponding pressing panel 25 is lowered down simultaneously. The filter bag with raw materials is put into the filter tank 22 and an oil extracting process is operated again.

The oil expeller as described has the following advantages. The oil expeller takes up little space, operates easily and extracts oil from the raw materials 40 and removes the waste product alternately. Moreover, the user is allowed to provide fresh oil based on his needs when extracting oil from a suitable amount of raw materials.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An oil expeller comprising a stand having a base being hollow and having a through hole formed through an upper surface of the base;

a supporting bracket mounted securely on the upper surface of the base and having a lower holder having a through hole formed through the lower holder and aligning with the through hole of the base; and at least one guider recess formed in an upper surface of the lower holder and through a side surface of the lower holder;

an upper holder mounted upper the lower holder and having a through hole formed through the upper holder;

multiple connecting rods mounted securely between the lower and upper holders; and at least one oil guider mounted in the at least one guider recess of the lower holder and protruding out of the side surface of the lower holder;

an upper cylinder mounted on the upper holder of the supporting bracket; and a lower cylinder mounted in the base;

an oil filter mounted in the supporting bracket of the stand and having an oil guiding base mounted on the lower holder of the supporting bracket and having a lower through hole formed through the oil guiding base and aligning with the through hole of the lower holder;

an annular groove formed in an upper surface of the oil guiding base and around the lower through hole of the oil guiding base;

an outer oil guiding surface defined in the annular groove, sloped and having at least one low point; and at least one oil outlet formed in a side surface of the oil guiding base, communicating with the annular groove and corresponding to the at least one low point of the outer oil guiding surface and the at least one oil guider of the supporting bracket;

a filter tank mounted on the oil guiding base and having multiple oil drain holes formed through the filter tank; and multiple oil flowing indentations formed separately in a lower peripheral edge of the filter tank;

a cover mounted on an upper peripheral edge of the filter tank and having an upper through hole formed through the cover;

multiple supporting rods mounted securely between the oil guiding base and the cover; and two pressing panels mounted movably in the filter tank; and a control device disposed beside the stand and having an oil tank;

multiple oil pipes communicating the oil tank to the upper and lower cylinders; and an oil control valve controlling oil flow between the oil tank and the upper and lower cylinders so the pressing panels are moved by the upper and lower cylinders.

2. The oil expeller as claimed in claim 1, wherein the oil guiding base further has an inner oil guiding surface formed around the lower through hole of the oil guiding base, disposed between the lower through hole and the annular groove and sloped down from the lower through hole to the side surface of the oil guiding base.

3. The oil expeller as claimed in claim 2, wherein the oil guiding base further has a positioning recess formed around and between the annular groove and the inner oil guiding surface;

the filter tank is mounted around the positioning recess of the oil guiding base; and each oil flowing indentation of the filter tank has a height higher than a drop height between the inner oil guiding surface and the positioning recess.

4. The oil expeller as claimed in claim 1, wherein the lower holder of the supporting bracket further has multiple fastening holes formed separately through the lower holder and arranged around the through hole of the lower holder;

the upper holder of the supporting bracket further has multiple fastening holes formed separately through the upper holder and arranged around the through hole of the upper holder;

each connecting rod of the supporting bracket further has two screws protruding respectively from two opposite ends of the connecting rod and mounted respectively through corresponding fastening holes of the lower and upper holders; and two threaded holes formed respectively in distal ends of the screws;

the supporting bracket further has multiple sleeves respectively mounted securely around the screws of the connecting rods, and each sleeve having an open end;

a closed end;

a countersink formed through the closed end of the sleeve; and an inner thread formed around an inner surface of the sleeve and fastening to a corresponding screw of a corresponding connecting rod; and multiple bolts mounted respectively through the countersinks of the sleeves and fastening to the threaded holes of the connecting rods.

5. The oil expeller as claimed in claim 2, wherein the lower holder of the supporting bracket further has multiple fastening holes formed separately through the lower holder and arranged around the through hole of the lower holder;

the upper holder of the supporting bracket further has multiple fastening holes formed separately through the upper holder and arranged around the through hole of the upper holder;

each connecting rod of the supporting bracket further has two screws protruding respectively from two opposite ends of the connecting rod and mounted respectively through corresponding fastening holes of the lower and upper holders; and two threaded holes formed respectively in distal ends of the screws;

the supporting bracket further has multiple sleeves respectively mounted securely around the screws of the connecting rods, and each sleeve having an open end;

a closed end;

a countersink formed through the closed end of the sleeve; and an inner thread formed around an inner surface of the sleeve and fastening to a corresponding screw of a corresponding connecting rod; and multiple bolts mounted respectively through the countersinks of the sleeves and fastening to the threaded holes of the connecting rods.

6. The oil expeller as claimed in claim 3, wherein the lower holder of the supporting bracket further has multiple fastening holes formed separately through the lower holder and arranged around the through hole of the lower holder;

the upper holder of the supporting bracket further has multiple fastening holes formed separately through the upper holder and arranged around the through hole of the upper holder;

each connecting rod of the supporting bracket further has two screws protruding respectively from two opposite ends of the connecting rod and mounted respectively through corresponding fastening holes of the lower and upper holders; and two threaded holes formed respectively in distal ends of the screws;

the supporting bracket further has multiple sleeves respectively mounted securely around the screws of the connecting rods, and each sleeve having an open end;

a closed end;

a countersink formed through the closed end of the sleeve; and an inner thread formed around an inner surface of the sleeve and fastening to a corresponding screw of a corresponding connecting rod; and multiple bolts mounted respectively through the countersinks of the sleeves and fastening to the threaded holes of the connecting rods.

7. The oil expeller as claimed in claim 4, wherein the base further has multiple positioning holes formed separately through the upper surface of the base and arranged around the through hole of the base; and the sleeves of the supporting bracket that are disposed on the lower holder are mounted respectively in the positioning holes of the base.

8. The oil expeller as claimed in claim 5, wherein the base further has multiple positioning holes formed separately through the upper surface of the base and arranged around the through hole of the base; and the sleeves of the supporting bracket that are disposed on the lower holder are mounted respectively in the positioning holes of the base.

9. The oil expeller as claimed in claim 6, wherein the base further has multiple positioning holes formed separately through the upper surface of the base and arranged around the through hole of the base; and the sleeves of the supporting bracket that are disposed on the lower holder are mounted respectively in the positioning holes of the base.

10. The oil expeller as claimed in claim 4, wherein the upper cylinder of the stand further has a piston rod mounted retractably down through the through hole of the upper holder; and the lower cylinder of the stand further has a piston rod mounted retractably up through the through holes of the base and the lower holder.

11. The oil expeller as claimed in claim 5, wherein the upper cylinder of the stand further has a piston rod mounted retractably down through the through hole of the upper holder; and the lower cylinder of the stand further has a piston rod mounted retractably up through the through holes of the base and the lower holder.

12. The oil expeller as claimed in claim 6, wherein the upper cylinder of the stand further has a piston rod mounted retractably down through the through hole of the upper holder; and the lower cylinder of the stand further has a piston rod mounted retractably up through the through holes of the base and the lower holder.

* * * * *